US006520188B1

(12) United States Patent
Carter-Williams

(10) Patent No.: US 6,520,188 B1
(45) Date of Patent: Feb. 18, 2003

(54) METHOD AND KIT FOR PERSONALIZING A HAIR STYLING TOOL

(76) Inventor: Tina Q. Carter-Williams, 28730 Pepperdine Dr., Hephzibah, GA (US) 30815

( * ) Notice: Subject to any disclaimer, the term of this patent is extended or adjusted under 35 U.S.C. 154(b) by 0 days.

(21) Appl. No.: 09/833,317

(22) Filed: Apr. 12, 2001

Related U.S. Application Data

(60) Provisional application No. 60/196,740, filed on Apr. 12, 2000.

(51) Int. Cl.[7] ..... A45D 2/00
(52) U.S. Cl. ..... 132/286; 16/903; 132/223
(58) Field of Search ..... 132/223, 286; 40/630, 913; 16/903, 435, 431, 421; 81/492; 283/79, 81; 206/575, 582, 224, 223

(56) References Cited

U.S. PATENT DOCUMENTS

| | | | | | |
|---|---|---|---|---|---|
| 1,277,739 | A | | 9/1918 | Marcel | |
| 1,622,834 | A | | 3/1927 | Marcel | |
| 1,858,410 | A | | 5/1932 | Morey | |
| 1,893,503 | A | | 1/1933 | Marcel | |
| 2,338,994 | A | | 1/1944 | Brittain | |
| 2,520,808 | A | * | 8/1950 | Miller | 16/421 |
| 3,215,148 | A | | 11/1965 | Emsellem et al. | |
| 3,224,454 | A | | 12/1965 | Quinio et al. | |
| 3,516,420 | A | | 6/1970 | Porter | |
| 3,787,993 | A | | 1/1974 | Lyon | |
| 3,965,590 | A | | 6/1976 | Algaze | |
| 4,498,668 | A | * | 2/1985 | Bowen | 273/73 R |
| 4,604,514 | A | | 8/1986 | Thaler et al. | |
| 4,825,732 | A | * | 5/1989 | Arnold | 81/492 |
| 5,058,959 | A | * | 10/1991 | Miles et al. | 301/108 |
| 5,165,143 | A | * | 11/1992 | Detchon | 16/421 |
| 5,197,605 | A | * | 3/1993 | Hampton | 296/582 |
| 5,267,487 | A | * | 12/1993 | Falco et al. | 74/558 |
| 5,281,288 | A | * | 1/1994 | Murray et al. | 156/83 |
| 5,330,230 | A | * | 7/1994 | Craig | 283/81 |
| 5,369,900 | A | * | 12/1994 | Garrison | 40/299 |
| 5,743,407 | A | * | 4/1998 | Williams | 206/575 |
| 5,893,375 | A | | 4/1999 | Majors | |
| 6,257,098 | B1 | * | 7/2001 | Circone | 81/492 |
| 6,279,168 | B1 | * | 8/2001 | Bean | 40/913 |

* cited by examiner

*Primary Examiner*—Todd E. Manahan
(74) *Attorney, Agent, or Firm*—Maria Reichmanis

(57) ABSTRACT

A method for retrofitting tools such as curling irons with identifying indicia, and a device and kit for implementing the method. The device consists of a cap that carries identifying indicia in the form of a selected color or combination of colors, letters and/or numbers, pattern, shape, or the like. The kit includes a plurality of such caps (all preferably carrying the same indicia), instructions for installing the caps on a tool, and (optionally) adapters for installing the caps on differently-sized handles.

16 Claims, 1 Drawing Sheet

METHOD AND KIT FOR PERSONALIZING A HAIR STYLING TOOL

This application claims the benefit of Provisional Application No. 60/196,740, filed Apr. 12, 2000.

BACKGROUND OF THE INVENTION

1. Field of the Invention

The present invention relates to hair styling tools such as curling irons. In particular, the present invention relates to a method and kit for personalizing a hair styling tool (or set of tools) with identifying indicia.

2. Discussion of Background

Curling irons are popular hair styling tools, having been used by stylists for many years to help create pleasing hair styles. Prior to the advent of permanents, home hair dryers, and heated rollers, curling irons were a convenient alternative to rollers: curling irons can be used to style dry hair, whereas rollers can only be used on wet hair. More recently, curling irons have increased in popularity due to their inherent versatility: they can be used to straighten hair or curl it, to create waves or curls of varying degree depending on the size of the tongs, and to create styles that appear natural or "set"; they are indispensable for creating the customized styles demanded by many present-day consumers. Many consumers prefer using curling irons to avoid damaging their hair with sometimes-harsh chemical treatments such as straighteners and permanents.

Many different types of curling irons are available, ranging from the relatively simple, early 20th century electric curling irons popularized by Frangois Marcel to complex styling tools. Marcel obtained several U.S. patents for his curling irons, including U.S. Pat. Nos. 1,277,739, 1,662,834, and 1,893,503, which describe curling irons with handles covered by heat insulating material. Majors (U.S. Pat. No. 5,893,375) discloses a padded leather sleeve which is used as a heat insulator for the clamping lever of a curling iron. Additional such devices include Thaler, et al. (U.S. Pat. No. 4,604,514), a curling iron with selectively lockable, rotatable handles. The tips of the handles carry locking members which are used for locking the outer sleeves of the handles against rotation. Porter (U.S. Pat. No. 3,516,420) shows a combination curling and straightening iron with covered handles. The handles have tips made of a material that is a poor heat conductor. Quinio (U.S. Pat. No. 3,224,454) and Emsellem, et al. (U.S. Pat. No. 3,215,148) equip their curling irons with several different-sized tubes for producing different degrees of curl.

Professional hair stylists typically have their own, personal sets of styling tools and supplies, including curling irons as well as hair dryers, clippers, brushes, combs, shampoos and conditioners, and the like. The popularity of curling irons, coupled with their relatively small size and utilitarian appearance, frequently results in their loss or misplacement. Few hair stylists affix any kind of permanent, identifying indicia to tools such as curling irons, making it essentially impossible to distinguish one stylist's tools from those of another stylist working in the same salon. In addition, stylists frequently borrow tools from each other, making it even more difficult to sort out which tool belongs where. Marking pens and tape can be useful for providing temporary identification, but writing tends to wear off and tape can easily be damaged or removed. Procedures such as engraving directly on the tool are possible, but tend to be relatively expensive and inconvenient.

Various schemes for identifying tools, accessories, and so forth are known. For example, Algaze (U.S. Pat. No. 3,965, 590) provides an ID carrier for use with pool cues, golf clubs, and ski poles, and like items. This device is placed on the tip of the item, and includes a strip that carries identifying data. Lyon (U.S. Pat. No. 3,787,993) uses color-coded bands to identify the type of gas in a container. Brittain (U.S. Pat. No. 2,338,994) shows an electric fuse plug with a coded cap that carries an identifying number or other symbol that allows someone to identify the fuse. Morey (U.S. Pat. No. 1,858,410) describes a removable, colored marker that can be used to identify different types of yarn on a winding cone.

Several of the above-described curling irons appear to include a tip or cap on either the handles or the curling tongs. For example, Quinio shows a handle with an end cap, and Emsellem, et al. mount a plastic cap on the tip of a roller. However, the designers of known curling irons do not appear to have considered the problem of distinguishing hair styling tools that belong to one person from those belonging to another. There is a need for a simple, cost-effective method for retrofitting hair styling tools such as curling irons with identifying indicia.

SUMMARY OF THE INVENTION

According to its major aspects and broadly stated, the present invention includes a method for retrofitting tools such as curling irons with identifying indicia, and a device and kit for implementing the method. The device consists of a cap that carries identifying indicia in the form of a selected color or combination of colors, pattern, shape, or the like. The kit includes a plurality of such caps (all preferably carrying the same indicia), instructions for installing the caps on a tool, and (optionally) adapters for fitting the caps to tools with differently-sized handles. All items in the kit are simple and easy to make, easy to use, and inexpensive; thus, the kit provides a cost-effective route for personalizing tools that belong to a particular individual.

The cap is an important feature of the present invention. The cap, which is preferably made of rubber, plastic, or similar material, carries identifying indicia in the form of a color or combination of colors, letters or numbers, pattern, shape, or some other feature that allows a viewer to easily distinguish one cap from another with different indicia. A hair stylist can personalize her tools using a set of caps with selected indicia that differ from those used by other stylists working in the same salon, making them easier to distinguish and harder to misplace.

The kit is another feature of the present invention. The kit includes a sufficient number of caps for retrofitting at least one curling iron (or other suitable tool) and preferably enough caps for use with several such tools. Optionally, the kit also includes adapters for fitting the caps to handles of different sizes (i.e., different shapes, diameters, etc.). This feature allows the use of standard-sized caps with a wider range of handles than would otherwise be possible.

Still another feature of the present invention is the method for installing the cap, which is made of a flexible material such as plastic or rubber. In many cases, the cap can simply be press-fitted onto a handle; in other cases, an adapter may be needed to help secure the cap onto the handle. Installation is quick and easy, and provides a cost-effective means for identifying one's own styling tools.

Other features and advantages of the present invention will be apparent to those skilled in the art from a careful reading of the Detailed Description of Preferred Embodiments presented below and accompanied by the drawings.

DETAILED DESCRIPTION OF A PREFERRED EMBODIMENT

Figure 1:
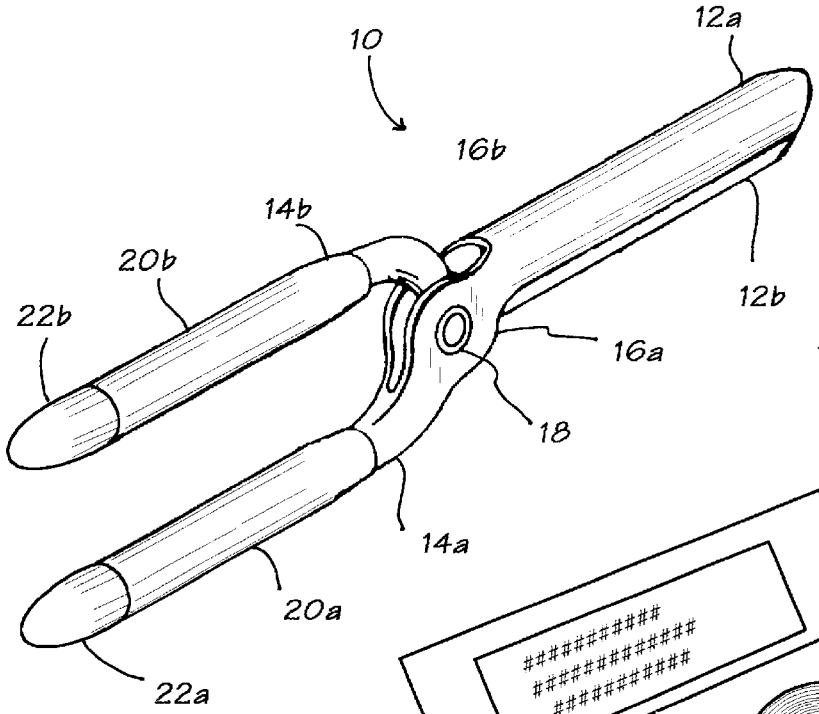
FIG. 1 is a perspective view of a curling iron fitted with identifying indicia according to a preferred embodiment of the present invention.

In the following detailed description of the invention, reference numerals are used to identify structural elements, portions of elements, surfaces or areas in the drawings, as such elements, portions, surfaces or areas may be further described or explained by the entire written specification. For consistency, whenever the same numeral is used in different drawings, it indicates the same element, portion, surface or area as when first used. Unless otherwise indicated, the drawings are intended to be read together with the specification, and are to be considered a portion of the entire written description of this invention as required by 35 U.S.C. §112. As used herein, the terms "horizontal," "vertical," "left," right," "up," "down," as well as adjectival and adverbial derivatives thereof, refer to the relative orientation of the illustrated structure as the particular drawing figure faces the reader.

Referring now to FIG. 1, there is shown a typical curling iron 10 with a pair of tongs or jaws 12*a*, 12*b*, a pair of handles 14*a*, 14*b*, and connector portions 16*a*, 16*b* connecting tongs 12*a*, 12*b* to handles 14*a*, 14*b*, respectively. Portions 16*a*, 16*b* are connected by a pivot 18 so that tongs 12*a*, 12*b* move towards and away from each other upon movement of handles 14*a*, 14*b* towards and away from each other, in the same fashion as pliers or scissors. Handles 14*a*, 14*b* may be made of heat-insulating material, or, alternatively, be encased in heat-insulating sheaths such as those indicated at 20*a*, 20*b*. Tongs 12*a*, 12*b* may be of any convenient size: indeed, professional stylists may have sets of curling irons, each iron having tongs of a different size for producing different degrees of curl.

In accordance with my invention, the tips of handles 14*a*, 14*b* are fitted with Toppers™: identifying indicia in the form of caps 22*a*, 22*b*, preferably caps made of heat-insulating material such as rubber, plastic, etc. In accordance with a preferred embodiment of the present invention, caps 22*a*, 22*b*are colored according to the owner's preference. That is, the owner of curling iron 10 installs caps 22*a*, 22*b*of a selected color, preferably a color that is different from that selected by other stylists working in the same beauty salon. Caps 22*a*, 22*b*may be of any selected color or combination or colors. The caps may carry additional (or alternative) indicia in the form of numbers or letters, aesthetically-pleasing designs, or be of a selected shape. A stylist may choose to install such caps 22*a*, 22*b*on all her curling irons (and other tools that can be fitted with the caps) in order to more easily distinguish her property from that of her neighbors.

Figure 2:
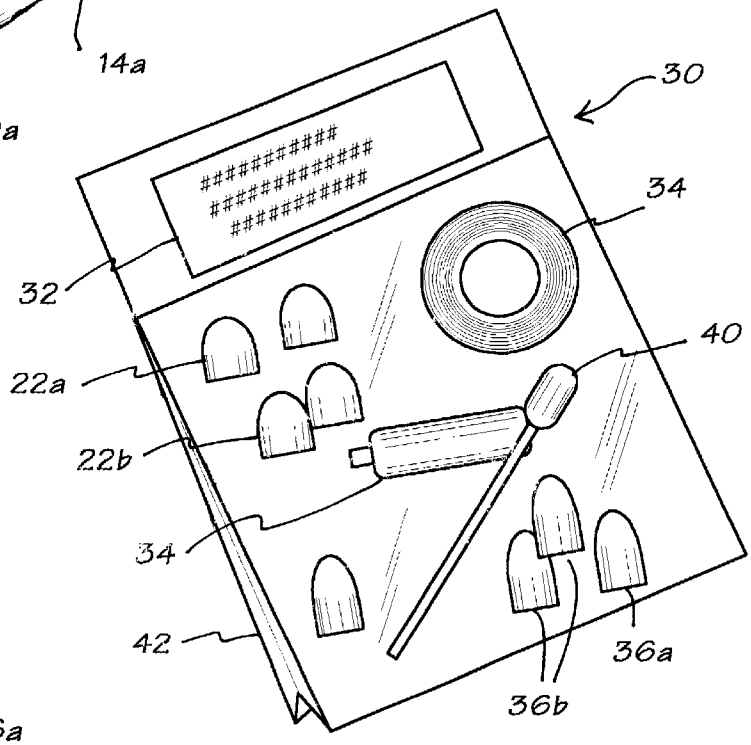
FIG. 2 shows a kit for retrofitting a tool such as a curling iron with the indicia of FIG. 1.

A kit 30 for retrofitting tools such as curling iron 10 with identifying caps 22*a*, 22*b*is shown in FIG. 2. Kit 30 includes a plurality of caps 22*a*, 22*b*, . . . , all preferably carrying the same indicia (such as color(s), letter(s), number(s), design (s), shape(s), etc.), instructions 32 for installing the caps on a tool, and (optionally) adapters for fitting the caps to differently-sized handles 14*a*, 14*b*. Suitable adapters may include a roll of tape 34 and/or a set of adapter caps 36*a*, 36*b*, . . . Tape 34 is wrapped about handles 14*a*, 14*b* that are somewhat smaller in diameter than the interior of caps 22*a*, 22*b*, thereby furthering a secure fit. If desired, kit 30 may include additional items, such as a tube 38 of adhesive for permanently mounting caps 20*a*, 20*b* on curling iron 10. A file 40 may be used for enlarging the interiors of caps 22*a*, 22*b*and/or filing down the tips of handles 14*a*, 14*b*. The items of kit 30 are enclosed in a package 42.

Figure 3A:
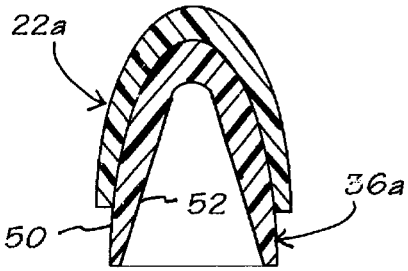
FIGS. 3A and 3B are cross-sectional views of the cap of FIG. 1, shown with adapters usable with the kit of FIG. 2.
Figure 3B:
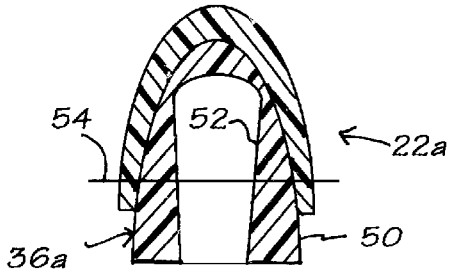

Adapter cap 36*a*is shown in cross-section FIGS. 3A and 3B. Cap 36*a*has an exterior 50 that mates with the interior of a cap 22*a*and, and a tapered interior wall 52 which allows it to be installed on handles having a range of sizes. Interior wall 52 may have any of a variety of different configurations, including but not limited to those shown in FIGS. 3A and 3B. Indeed, adapter caps such as cap 36*a*may be used instead of, caps 22*a*, 22*b*. If desired, cap 36*a*can be cut at a line 54 that depends on the relative sizes of handle 14*a* (installed therein) and the interior of the cap.

Kit 30 can be provided with caps 22*a*, 22*b*and adapters (including but not necessarily limited to tape 34, adapter caps 36*a*, 36*b*, . . . , adhesive 38, and file 40) usable with virtually any size of handle found on tools such as curling iron 10. Caps 22*a*, 22*b*carry any of a wide range of identifying indicia, thus, a stylist can easily select a kit 30 that is unlikely to be duplicated by another person working in the same area.

Tape 34 may be plastic, cloth, or rubber tape. Caps 22*a*, 22*b*(and adapter caps 36*a*, 36*b*, if used) are preferably made of a material such as rubber or plastic that is at least somewhat flexible and conformable, so that the caps conform generally to the shape of the tips of handles 14*a*, 14*b*. Other thermally-insulating and/or electrically-insulating materials may also be suitable.

Kit 30 contains simple, easy-to-use, generally inexpensive items, making it a cost-effective approach for marking tools. Use of kit 30 to retrofit hair styling tools renders it possible to quickly and easily distinguish one's own tools from those of colleagues, so the tools are easier to identify and harder to misplace.

With respect to the above description of the invention, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing description is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. Thus, it will be apparent to those skilled in the art that many changes and substitutions can be made to the preferred embodiment herein described without departing from the spirit and scope of the present invention as defined by the appended claims.

What is claimed is:

1. A kit for installing identifying indicia on the handles of a tool, said kit comprising:

a plurality of devices carrying identifying indicia;

a plurality of adapters, said adapters usable to install said devices on differently-sized handles, said plurality of adapters including at least one adapter cap having a tapered interior wall, said at least one adapter cap being installable on a handle of said tool between said handle and a selected one of said plurality of devices; and instructions for installing said devices and said adapters on the handles of a selected tool.

2. The kit as recited in claim 1, wherein said plurality of devices further comprises a plurality of caps.

3. The kit as recited in claim 1, wherein said identifying indicia are selected from the group consisting of color, shape, alphanumeric characters, designs, and combinations thereof.

4. The kit as recited in claim 1, wherein said plurality of devices are made of thermally-insulating or electrically-insulating material.

5. The kit as recited in claim 1, wherein said plurality of devices are made of rubber or plastic.

6. The kit as recited in claim 1, further comprising:

a quantity of adhesive; and a file.

7. The kit as recited in claim 1, further comprising a package containing said plurality of devices, said plurality of adapters, and said instructions.

8. A method for installing identifying indicia on the handles of a tool, said method comprising the steps of:

selecting a device carrying identifying indicia;

installing an adapter cap having a tapered interior wall on an end of a handle of said tool; and installing said device on a handle of said tool.

9. The method as recited in claim 8, wherein said tool has a pair of handles, further comprising installing a device carrying identifying indicia on each of said handles.

10. The method as recited in claim 8, wherein said identifying indicia are selected from the group consisting of color, shape, alphanumeric characters, designs, and combinations thereof.

11. The method as recited in claim 8, wherein said device is made of thermally insulating material or an electrically insulating material.

12. The method as recited in claim 8, wherein said device is made of rubber or plastic.

13. The method as recited in claim 8, wherein said tool has a pair of handles, further comprising installing a device carrying identifying indicia on each of said handles.

14. The method as recited in claim 8, further comprising the initial step of selecting said device from a kit containing a plurality of said devices and a plurality of adapters for fitting said devices to differently-sized handles.

15. A device for use in identifying a tool having at least one handle, comprising:

an item carrying identifying indicia, said item configured for installation on an end of said handle, said identifying indicia selected from the group consisting of color, shape, alphanumeric characters, designs, and combinations thereof; and an adapter cap having a tapered interior wall for adapting said item to handles of different size, said adapter cap being installable on said end between said handle and said item.

16. The device as recited in claim 15, wherein said item is made of plastic or rubber.

* * * * *